United States Patent [19]

Bagalini

[11] Patent Number: 4,904,969

[45] Date of Patent: Feb. 27, 1990

[54] ELECTRIC CIRCUIT BREAKER

[75] Inventor: Dante Bagalini, Johannesburg, South Africa

[73] Assignee: Circuit Breaker Industries Limited, Elandsfontein, South Africa

[21] Appl. No.: 226,476

[22] Filed: Jul. 29, 1988

[51] Int. Cl.[4] ..... H01H 9/20

[52] U.S. Cl. ..... 335/167; 335/23; 335/172

[58] Field of Search ..... 335/6, 21, 22, 23, 26, 335/27, 28, 35, 36, 37, 38, 40, 41, 167, 168, 170, 185, 172

[56] References Cited

U.S. PATENT DOCUMENTS 2,890,306 6/1959 Rypinski et al. ..... 335/41

3,486,140 12/1969 Harper ..... 335/21

*Primary Examiner*—Gerald P. Tolin

*Assistant Examiner*—Lincoln Donovan

*Attorney, Agent, or Firm*—Ladas & Parry

[57] ABSTRACT

A circuit breaker mechanism has an armature component that is slidably displaceable between latched and tripping positions. The armature is connected to a moving contact carrier that is pivotally connected to an operating handle that is also pivotal. The armature is connected to the carrier by a spring. The armature has a latching formation which engages a projection. When tripped,the armature is slightly pivoted to clear the projection.

19 Claims, 2 Drawing Sheets

ELECTRIC CIRCUIT BREAKER

This invention relates to a circuit breaker mechanism and to circuit breakers.

According to the invention there is provided a circuit breaker mechanism, which includes

- an operating handle, which is pivotal about a pivotal axis between on, off and tripped positions and which has an armature engaging portion;
- a moving contact carrier which is pivotally connected with the operating handle at a pivotal connection region that is spaced from the pivotal axis of the operating handle to be pivotal between on and off positions;
- an armature component that is substantially slidably displaceable between latched and tripped positions and has a reset portion engageable by the armature engaging portion of the operating handle; and
- an urging means connected between the contact carrier and the armature component for displacing the armature component, the contact carrier and the operating handle.

It will be appreciated by those skilled in the art that the armature component is held in a particular position under normal operating conditions, and when the breaker is to trip, the armature component is released so that it is then free to slide. The armature component may be released by displacing a displaceable latching element out of engagement therewith so that the armature component is free to slide, or by displacing the armature component relative to a fixed holding element, the armature component having a complementary latching formation. With this arrangement, in which the armature component is displaced the armature component may then be mounted to be slightly pivotal so that the armature component can pivot sufficiently and only to the extent necessary to engage and disengage the holding element. Thus, the armature component may be pivotal about a pivot point that is slidable.

In a preferred arrangement, the pivotal connection of the moving contact carrier to the operating handle is located between the armature component and the pivotal axis of the operating handle.

The reset portion of the armature component is engaged by the armature engaging portion of the operating handle when the armature component is to be reset after it has slid to trip the mechanism. The operating handle may thus be displaced to its off position to reset the armature and return it to its latched position.

If the armature component is slightly pivotal as indicated above, then the urging means may be connected to the armature component at a point which is between the pivot point of the armature component and the pivotal connection region between the moving contact carrier and the operating handle, and it may be connected with the moving contact carrier at a point which is on the other side of the pivot point to the connection point of the urging means to the armature component.

In a preferred embodiment, only a single urging means, in the form of a tension spring, is utilized to displace the various items, although an auxiliary spring may be provided to urge the armature component into latching engagement with the holding element. Thus, in a preferred configuration, the various items constituting the mechanism as described above may be shaped and connected together in such a manner that one spring is sufficient to move the contact carrier between its on and off positions when the operating handle is moved between its on and off positions and when the armature component is in its latched position, and to move the armature component from its latched position to its tripped position as well as moving the carrier from its on position to its off position and the operating handle from its on position to its tripped position when a trip condition occurs.

Thus the pivotal axis of the operating handle, and the connection point of the spring to the armature component may define a first line when the armature component is in its latched position. When the operating handle and the carrier are in their on positions the pivotal connection region may be on the same side of the first line as a major part of the armature component. In order to displace the moving contact carrier into its off position, when the operating handle is pivoted from its on position to its off position, the pivotal connection region of the moving contact carrier to the operating handle is caused to move from the armature side of the first line to the other side thereof, causing the contact carrier to pivot about the pivotal connection region into its off position, in which a contact that it is carrying is moved away from a stationary contact. Similarly, by pivoting the operating handle from its off position to its on position, the pivotal connection region crosses back over the first line again so that the contact carrier is caused to pivot into its on position in which its moving contact mechanically and electrically contacts the stationary contact.

Similarly, when the mechanism is in its on configuration, then the connection point of the spring to the contact carrier is located relative to the connection point of the spring to the armature component so that a line between the two connection points is at an acute angle to the direction in which the armature component slides. Thus, if there is a tripping condition so that the armature component is unlatched, the spring will exert a force on the armature component causing it to slide. As the armature component slides, the connection point of the spring to the armature component will move from one side to the other of a line drawn between the connection point of the spring to the moving contact carrier and the pivotal connection region, causing the contact carrier to pivot. As the armature component slides and the contact carrier pivots, a configuration will be reached in which the connection point of the spring to the contact carrier, the connection point of the spring to the armature component, the pivotal connection region and the pivotal axis will all be in a straight line. Further sliding movement of the armature component will cause the pivotal connection region to cross this line, so that the interconnection of the contact carrier and the operating handle will transfer forces exerted on the contact carrier by the spring to the operating handle causing it to pivot. In the preferred embodiment referred to, the operating handle is then caused to pivot to a position intermediate its on and off positions, such that a tripped condition is indicated.

It will be appreciated that if the pivot point of the armature component is on one side of a line between the connection point of the spring to the contact carrier and the armature component, and the latching formation of the armature component is on the other side thereto, and if the holding element is on the same side of the armature component as the connection point of the spring to the contact carrier, then the spring will also exert a force on the armature component to pivot it into latching engagement with the holding element. Thus, a single spring may be used which provides the contact pressure, blow off of the moving contact carrier and the magnetic trip level. However, if desired, a further spring may be provided to displace the armature component when it is tripped.

In a further development of the invention, the mechanism may have a bi-metal element which is engageable with the armature component In a preferred form, the bi-metal strip may be on the other side of the armature component to the holding element. Thus, an arm may extend from the armature component, past the bi-metal strip and a hook portion may project from the arm to be engageable by the bi-metal strip upon deformation thereof. The hook portion may be deformable towards and away from the armature component, thereby being deformed to be closer or further away from the bi-metal strip, in order to calibrate the mechanism. Instead, the hook portion may be deformable parallel to the armature component, i.e. perpendicularly to the arm. If the bi-metal strip is then at an angle to the armature component, an edge of the hook portion that is engaged by the bi-metal strip will move closer or further away from the bi-metal strip, as the hook portion is moved to one or other side.

The invention extends to a circuit breaker which includes a mechanism as described above.

The invention is now described, by way of examples, with reference to the accompanying drawings in which.

Figure 1:
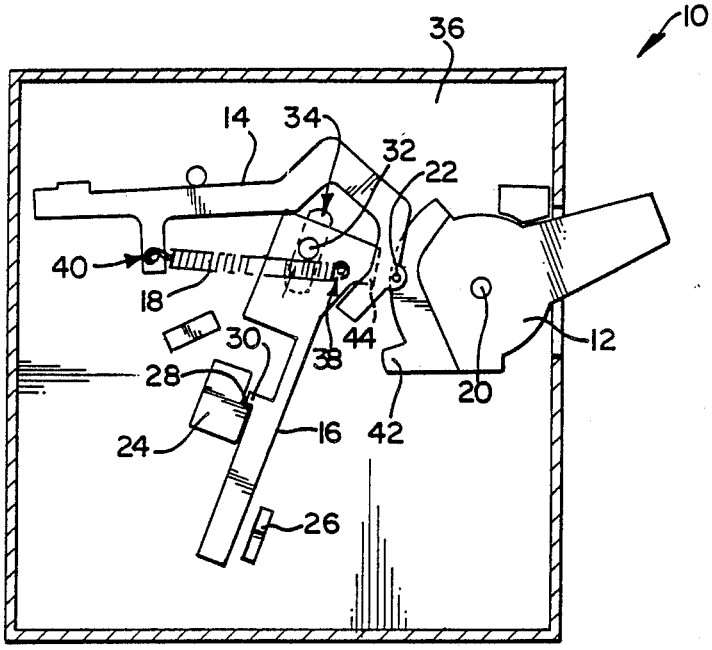
FIGS. 1, 2 and 3 show schematically a circuit breaker mechanism in accordance with the invention, FIG. 1 showing the mechanism in its on configuration, FIG. 2 showing the mechanism in its off configuration and FIG. 3 showing the mechanism in its tripped configuration.
Figure 2:
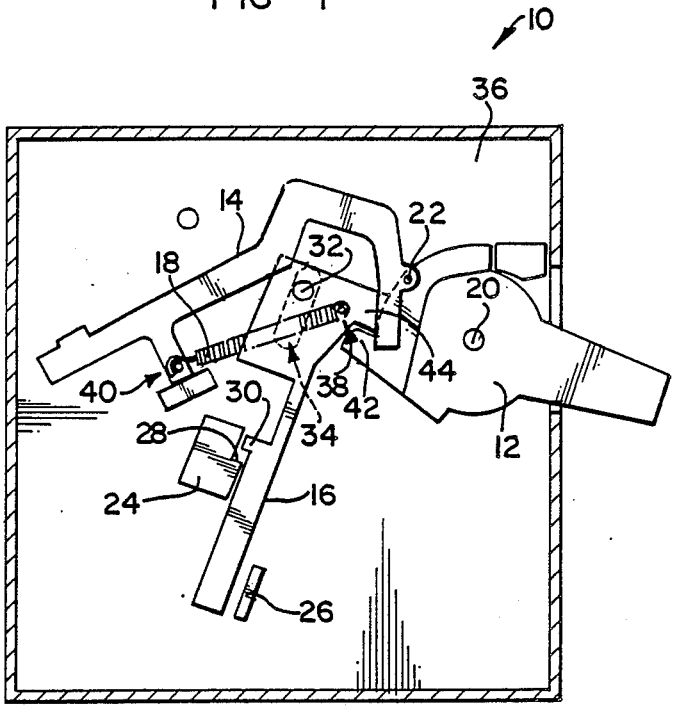
Figure 3:
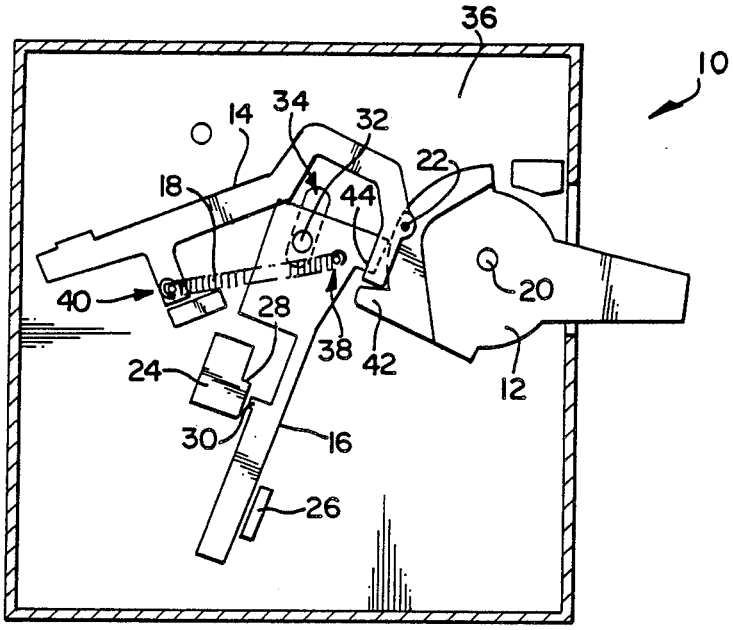

Referring to FIGS. 1 to 3, a circuit breaker mechanism is designated generally by reference numeral 10. The mechanism 10 has an operating handle 12, a moving contact carrier 14, an armature 16 and a spring 18. The operating handle 12 is pivotal about a pivot pin 20 to be pivotal about a pivotal axis. The contact carrier 14 is pivotally engaged with the operating handle 12 by means of a further pivot pin 22 which provides a pivotal connection.

The armature component 16 is substantially slidably moveable between guide formations 24 and 26. The guide formation 24 has a holding shoulder 28 which engages a latch formation 30 on the armature component 16 to latch the armature component 16 in its normal operating position. For the sake of simplicity components which will, in use, produce a tripping magnetic field which is utilized to displace the armature component 16 away from the guide formation 24 to disengage its latch formation 30 from the shoulder 28, are not shown. It will further be appreciated that although the armature component 16 is substantially slidably moveable, it nonetheless pivots slightly to disengage the latch formation 30 from the holding shoulder 28. Thus, the armature component 16 has a projection 32 that slides in a slot 34 in a base member 36 and is also pivotal therein. The spring 18 is connected, at one end, to the armature component 16, at a connection point 38 and to the contact carrier 14 at a connection point 40.

The operating handle 12 further has a nose 42 that engages a tab 44 on the armature component 16 to reset it, as will be explained below.

Referring now, more particularly to FIGS. 1 and 2, it will be appreciated that in its normal operating configuration, the armature component 16 does not move when the operating handle 12 is displaced from its on position shown in FIG. 1 to its off position show in FIG. 2, with corresponding movement of the contact carrier 14. Similarly, the armature component 16 is not moved when the operating handle 12 is moved from its off position shown in FIG. 2 to its on position shown in FIG. 1 with corresponding movement of the contact carrier 14. Thus, when the armature component 16 is in its normal operating position, its projection 32 does not move when the operating handle 12 and contact carrier 14 move between their on and off positions. In the on configuration, the pivotal connection 22 is below a line between the pivot pin 20 and the connection point 38 (as shown in FIG. 1). Thus, when the operating handle 12 is pivoted, causing the pivotal connection 22 to cross to the other side of this line, the contact carrier 14 is caused to pivot about the pivotal connection to the position shown in FIG. 2. Correspondingly, when the operating handle 12 is pivoted from its off position shown in FIG. 2 to its on position shown in FIG. 1, the pivotal connection 22 again crosses the line so that the spring 18 causes the contact carrier 14 to pivot about its pivotal connection 22 into its on position as shown in FIG. 1.

Further, if the mechanism is in the on configuration shown in FIG. 1 and a tripping condition occurs such that the armature component 16 is pivoted about its projection 32 so that its latch formation 30 disengages the shoulder 28, then the armature component 16 slides downwardly to the position shown in FIG. 3. A sliding force is exerted on the armature component 16 because a line drawn between the connecting points 38 and 40 is at an acute angle to the direction in which the armature component 16 slides. Further, as the armature component 16 slides a configuration is reached in which the connecting point 38 crosses a line drawn between the connecting point 40 and the pivotal connection 22. As a result, the carrier 14 starts pivoting away from its on position about the pivotal connection 22. Eventually, a stage is reached in which the connecting point 40, the connecting point 38, and the pivotal connection 22 are all in a straight line. Further sliding of the armature component 16 results in the pivotal connection 22 moving across this line so that a pivoting force is exerted on the operating handle 12 causing it to pivot into a position intermediate its on and off positions, indicating a tripped condition. When the mechanism 10 is in its tripped configuration as shown in FIG. 3, if the operating handle 12 is displaced towards its off position, its nose 42 engages the tab 44 to slide the armature component 16 back to its normal position. Because the projection 32 is on one side of the spring 18 and the latch formation 30 is on the other side thereto facing towards the connecting point 40, the spring 18 causes the armature component 16 to pivot about its projection 32 so that the latch formation 30 again engages the holding shoulder 28.

It will be appreciated that the mechanism will trip even if the operating handle 12 is held in its on position, such that the carrier 14 is displaced to its off position and the operating handle 12 moves to its tripped position when released.

Figure 4:
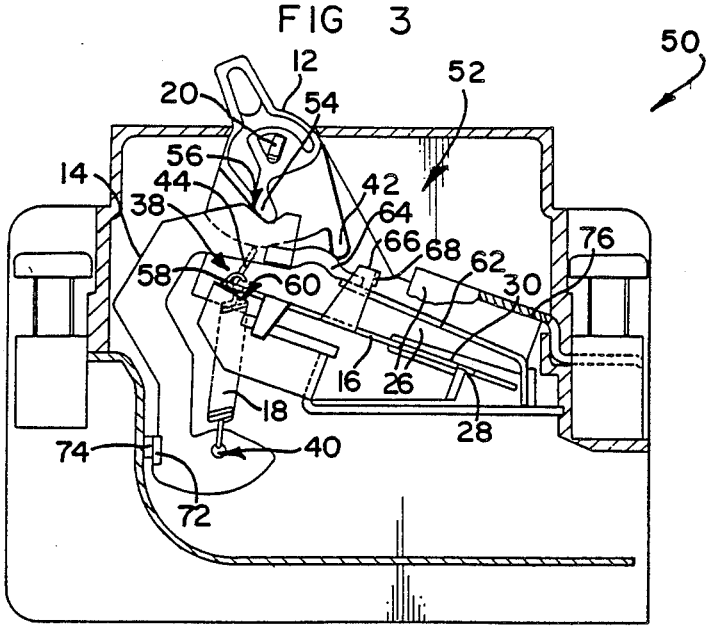
FIG. 4 shows schematically a circuit breaker which has a further embodiment of a mechanism in accordance with the invention.

Referring to FIG. 4, a circuit breaker having a mechanism similar to that shown in FIGS. 1 to 3 is designated generally by reference numeral 50. The breaker 50 has a mechanism 52 that is similar to the mechanism 10 and is similarly referenced. However, with the mechanism 52, the contact carrier 14 is not pivotally connected with the operating handle 12 by means of a pivot pin, but the operating handle 12 has a spur 54 that seats in a recess 56 in the contact carrier 14. Further, the armature component 16 does not have a projection 32. Instead, an end region 58 slides and pivots along a face 60 that is at an angle to the armature component 16.

Figure 5:
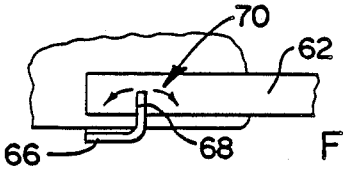
FIG. 5 shows, in more detail, a calibration facility of the circuit breaker of FIG. 4.

Further, with reference to FIG. 4, the circuit breaker 50 has a bi-metal strip 62 that is mounted cantilever fashion at one end and at its other end is connected to the contact carrier 14 by means of a flexible strap 64. The bi-metal strip 62 is on the opposite side of the armature component 16 to the holding shoulder 28. The armature component 16 thus has an arm 66 which extends past the bi-metal strip 62. The arm 66 extends substantially perpendicularly from the armature component 16 and has a hook portion 68 that extends therefrom over the bi-metal strip 62. The hook portion 68 may be bent towards or away from the bi-metal strip 62 in order to calibrate the mechanism 52. Alternatively, the bi-metal strip 62 may be at an angle to the armature component 16 so that by bending the hook portion sideways, as indicated by arrows 70 in FIG. 5, a bottom edge of the hook portion 68 is brought closer to or moved away from the bi-metal strip 62.

A tripping magnetic field is generated by current flow in the bi-metal strip 62 and a solenoid portion 76, with the guides 26 also acting as pole pieces.

It will be appreciated that the spring 18 controls all the parameters of the mechanism 52. Thus, the spring 18 controls the contact pressure between a moving contact 72 carried by the carrier 14 and a stationary contact 74, the blow off of the moving carrier and the magnetic trip level.

By means of the invention a circuit breaker mechanism is provided that has a minimal number of components, and eliminates the need for a separate armature spring.

I claim:

1. A circuit breaker mechanism, which includes an operating handle, which is pivotal about a pivotal axis between on, off and tripped positions and which has an armature engaging portion;

a moving contact carrier which is pivotally connected with the operating handle at a pivotal connection region that is spaced from the pivotal axis of the operating handle to be pivotal between on and off positions;

an armature component that is substantially slidably displaceable between latched and tripped positions and has a reset portion engageable by the armature engaging portion of the operating handle, said armature component having a latching formation a fixed holding element that is engaged by the latching formation to hold the armature component in its latched position; and an urging means connected between the contact carrier and the armature component for displacing the armature component, the contact carrier and the operating handle.

2. The mechanism in claim 1 in which the armature component is slightly pivotal about a pivot point to disengage the latching formation from the holding element and thereby to permit sliding of the armature component to its tripped position.

3. The mechanism in claim 1, in which the pivot point is slidable.

4. A circuit breaker mechanism, which includes an operating handle, which is pivotal about a pivotal axis between on, off and tripped positions and which has an armature engaging portion;

a moving contact carrier which is pivotally connected with the operating handle at a pivotal connection region that is spaced from the pivotal axis of the operating handle to be pivotal between on and off positions;

an armature component that is substantially slidably displaceable between latched and tripped positions and has a reset portion engageable by the armature engaging portion of the operating handle, said pivotal connection region of the contact carrier to the operating handle being located between the armature component and the pivotal axis of the operating handle; and an urging means connected between the contact carrier and the armature component for displacing the armature component, the contact carrier and the operating handle.

5. A circuit breaker mechanism, which includes an operating handle, which is pivotal about a pivotal axis between on, off and tripped positions and which has an armature engaging portion;

a moving contact carrier which is pivotally connected with the operating handle at a pivotal connection region that is spaced from the pivotal axis of the operating handle to be pivotal between on and off positions;

an armature component that is substantially slidably displaceable between latched and tripped positions and has a reset portion engageable by the armature engaging portion of the operating handle, said armature engaging portion of the operating handle being engageable with the reset portion of the armature component when the operating handle is in its tripped position and the armature component is in its tripped position and the operating handle is pivoted to its off position to displace the armature component to its latched position; and an urging means connected between the contact carrier and the armature component for displaceing the armature component, the contact carrier and the operating handle.

6. The mechanism claimed in claim 2, in which the urging means is connected to the armature component at a point thereon that is between the pivot point of the armature component and the pivotal connection region between the contact carrier and the operating handle.

7. The mechanism claimed in claim 6, in which the urging means is connected to the contact carrier at a point which is on the other side of the pivot point of the armature component to the connection point of the urging means to the armature component.

8. The mechanism claimed in claim 7, in which the urging means comprises a tension spring.

9. The mechanism claimed in claim 7, in which the pivotal axis of the operating handle and the connection point of the urging means to the armature component define a first line when the armature component is in its latched position, and the connection point of the urging means to the contact carrier is on a first side of this first line and the connection region between the contact carrier and the operating handle is on the other second side of the said first line when the operating handle and the contact carrier are in their off positions.

10. The mechanism claimed in claim 9, in which the connection region between the contact carrier and the operating handle is on the said first side of the first line when the contact carrier and the operating handle are in their on positions and the armature component is in its latched position.

11. The mechanism claimed in claim 10, in which a second line between the connection points of the urging means to the contact carrier and the armature component when the armature component is in its latched position and the contact carrier is in its on position subtends an acute angle with the direction in which the armature component slides when it moves from its latched position to its tripped position.

12. The mechanism claimed in claim 10, in which the first line moves when the operating handle and the armature component are in their on positions and the armature component moves from its latched position to its tripped position such that the connection region between the contact carrier and the operating member moves from the said first side of the first line to its second side.

13. The mechanism claimed in claim 7, in which a second line is defined between the connection points of the urging means to the contact carrier and the armature component and the pivot point is always on one side thereof and the holding element is always on the other side thereof.

14. The mechanism claimed in claim 13, in which the latching formation is on the same side of the armature component as the connection point of the urging means to the contact carrier.

15. The mechanism claimed in claim 1, which includes a bi-metal strip engageable with the armature component to displace it so that its latching formation disengages from the holding element.

16. The mechanism claimed in claim 15, in which the bi-metal strip is on the other side of the armature component to the holding element.

17. The mechanism claimed in claim 16, in which the armature component has an arm that extends therefrom past the bi-metal strip, with a hook portion that projects from the arm to be engageable by the bi-metal strip upon deformation thereof.

18. The mechanism claimed in claim 17, in which the hook portion is deformable towards and away from the armature component, in order to calibrate the mechanism.

19. The mechanism claimed in claim 17, in which the bi-metal strip is at an angle to the armature component and the hook portion is deformable parallel to the armature component to calibrate the mechanism.

* * * * *